United States Patent [19]

Pepper

[11] Patent Number: 4,553,357

[45] Date of Patent: Nov. 19, 1985

[54] ADJUSTABLE RAINWATER GUTTER MOUNTING ARRANGEMENT

[75] Inventor: Kenneth V. Pepper, Elkhart Lake, Wis.

[73] Assignee: Bemis Manufacturing Company, Sheboygan Falls, Wis.

[21] Appl. No.: 587,451

[22] Filed: Mar. 8, 1984

[51] Int. Cl.[4] ..... E04D 13/00

[52] U.S. Cl. ..... 52/12; 248/48.1; 248/299

[58] Field of Search ..... 52/11; 248/48.1, 48.2, 248/299

[56] References Cited

U.S. PATENT DOCUMENTS

| | | | |
|---|---|---|---|
| 288,307 | 11/1883 | Campbell | 248/48.2 |
| 462,849 | 11/1891 | McCornack | 248/299 X |
| 514,758 | 2/1894 | Lewis | 248/48.2 |
| 707,941 | 8/1902 | Pope | 248/48.1 |
| 972,291 | 10/1910 | Thomas | 248/48.1 |
| 1,278,318 | 9/1918 | Edsall | 248/299 |
| 1,294,518 | 2/1919 | Mowry | 248/299 |
| 2,024,348 | 12/1935 | Feltman | 248/48.2 |
| 3,057,117 | 10/1962 | Singer | 52/11 |

FOREIGN PATENT DOCUMENTS

| | | | |
|---|---|---|---|
| 74506 | 4/1894 | Fed. Rep. of Germany | 248/48.1 |

*Primary Examiner*—Donald G. Kelly
*Assistant Examiner*—Creighton Smith
*Attorney, Agent, or Firm*—Dressler, Goldsmith, Shore, Sutker & Milnamow, Ltd.

[57] ABSTRACT

An adjustable mounting arrangement is disclosed which facilitates mounting of a rainwater gutter assembly in its proper horizontal disposition on a fascia board or like supporting surface which is inclined with respect to the vertical. The mounting arrangement is adapted to be positioned generally between the supporting surface and the associated gutter, and includes a base portion adapted to be affixed to the supporting surface. The arrangement further includes a pad portion adapted to abut and mate with the base portion in any one of a plurality of relative positions. For secure cooperation of the elements, the mating surfaces of the base and pad portions are preferably of complemental, arcuate configurations, with first and second interengagable teeth respectively provided on the base and pad portions for securely maintaining them in the selected one of their plurality of relative positions.

5 Claims, 7 Drawing Figures

FIG. 5
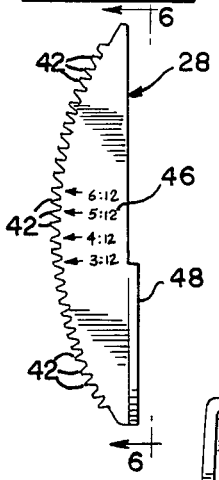
FIG. 4
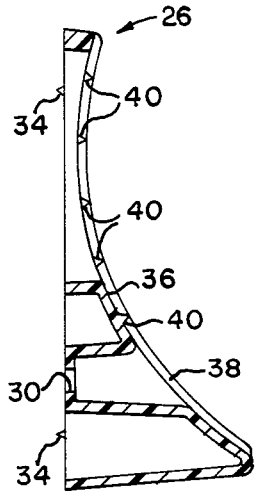
FIG. 3
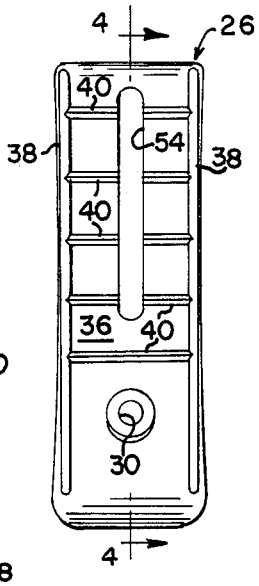
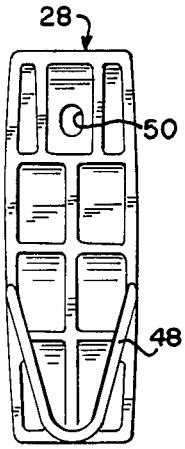
FIG. 6
FIG. 7
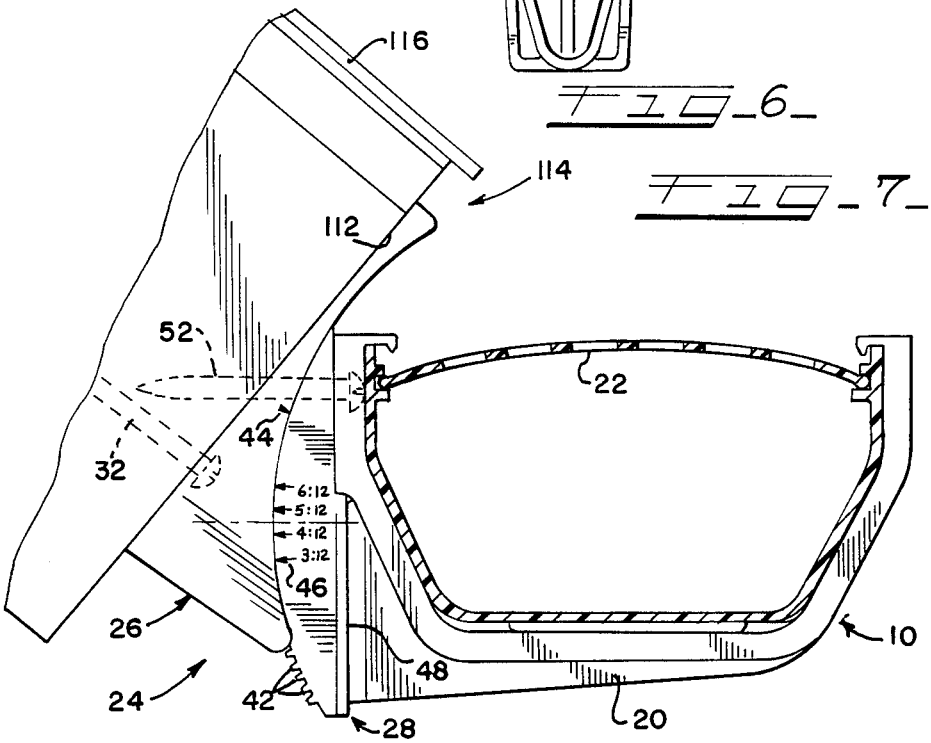

ADJUSTABLE RAINWATER GUTTER MOUNTING ARRANGEMENT

TECHNICAL FIELD

The present invention relates generally to rainwater gutter assemblies, and more particularly to an adjustable mounting arrangement for a gutter assembly to facilitate mounting of the gutter in a horizontal disposition on a fascia board or like supporting surface which is inclined from the vertical.

BACKGROUND OF THE INVENTION

Rainwater gutter assemblies are typically positioned just below the edge of a roof of a structure on the so-called fascia board or other supporting surface. Water which runs off of the roof is received by the gutter and is channeled to a suitable downspout or the like and directed away from the structure. While gutter assemblies of wood or metal have long been used, plastic gutter assemblies are becoming increasingly popular in view of their ease of installation, corrosion-resistance and durability, and attractive appearance.

One design feature which is inherent in most gutter assemblies is configuration for mounting on a vertically oriented fascia board or like surface. While many fascia boards of structures are in fact vertically oriented, it is not at all unusual for the fascia board of a structure to be reversely or inwardly inclined for decorative effect. In the past, this has not unduly complicated installation of gutter assemblies since most roofs were of only two different standardized pitches, such as four-to-twelve or six-to-twelve, referring to the rise of the roof in feet for every twelve feet of its span. Thus, reversely inclined fascia boards were ordinarily of one or two different corresponding angles from the vertical, and installation of a gutter assembly in its correct horizontal disposition was accommodated by the provision of wedges or the like.

More recently, the use of prefabricated roof trusses has become increasingly widespread in view of the sophisticated load-bearing configurations that can be achieved with the economy of mass-production. By these prefabrication techniques, a wider range of roof pitches for residential structures can be readily achieved, and roof pitches may range from three-to-twelve to ten-to-twelve. Fascia boards affixed perpendicularly to the rafters of such roofs can therefore vary from about fourteen degrees to about forty degrees from the vertical.

Accordingly, it is very desirable to provide an adjustable mounting arrangement for a gutter assembly to facilitate mounting of the gutter in a horizontal disposition on fascia boards or like supporting surfaces of varying angular dispositions with respect to the vertical.

SUMMARY OF THE INVENTION

In accordance with the present invention, an adjustable mounting arrangement for a rainwater gutter assembly is disclosed which facilitates mounting of the gutter in horizontal disposition on an associated supporting surface which is inclined from the vertical. The present mounting arrangement is adapted for positioning generally between the gutter and the supporting surface, and is configured for maintaining the gutter in any one of a plurality of angular dispositions with respect to the supporting surface. In this manner, the gutter can readily be mounted in a generally horizontal disposition even when the supporting surface is disposed at an angle to the vertical, with the adjustable nature of the mounting arrangement permitting its use for mounting on surfaces which fall within a wide range of angular orientations.

The present mounting arrangement is desirably straightforward in configuration for ease of manufacture and use, and comprises a first base portion which is configured to abut the supporting surface or fascia board. The arrangement further includes a second pad portion configured to mate with and abut the base portion in any one of a plurality of relative positions. In the preferred form, the base and pad portions are respectively provided with mating surfaces having generally arcuate, complemental configurations, and further preferably include interengaging means for maintaining the base and pad portions in any one of their relative positions.

The interengaging means of the mounting arrangement preferably comprises one or more teeth defined by at least one of the base and pad portions for interengagement with the other of the base and pad portions. It is further preferred that the interengaging means comprises a plurality of first teeth on one of the base and pad portions, and a relatively greater plurality of second teeth on the other of the base and pad portions for interengagement with at least some of the first teeth in any one of the relative positions of the base and pad portions. Thus, in the illustrated embodiment, the arcuate mating surface of the base portion is provided with a plurality of transversely extending first teeth, while the complemental arcuate mating surface of the pad portion is provided with a relatively greater plurality of second teeth.

In use, the base portion of the mounting arrangement is adapted to be affixed to the fascia board supporting surface with a suitable mechanical fastener. The pad portion is then fitted against the base portion in the desired relative position, with the gutter assembly adapted to abut and be supported by the pad portion. In the illustrated embodiment, the gutter assembly comprises a gutter bracket through which extends a mechanical fastener, which further extends through the mounting arrangement into the fascia board. To this end, the pad portion defines a fastener opening for receiving the fastener therethrough, with the base portion of the arrangement defining an elongated fastener opening to facilitate disposition of the fastener therethrough in any one of the plurality of relative positions of the base and pad portions.

Numerous other features and advantages of the persent invention will become readily apparent from the following detailed description, the accompanying drawings, and the appended claims.

BRIEF DESCRIPTION OF THE DRAWINGS

FIG. 3 is an elevational view of the base portion of the present adjustable mounting arrangement;

FIG. 4 is a cross-sectional view taken along lines 4—4 of FIG. 3 of the base portion of the present mounting arrangement;

FIG. 5 is a side elevational view of the pad portion of the present adjustable mounting arrangement;

FIG. 6 is a further elevational view of the pad portion shown in FIG. 5 taken along lines 6—6 in FIG. 5; and FIG. 7 is a view similar to FIG. 2 illustrating use of the present adjustable mounting arrangement on an associated structure having a fascia board supporting surface which is inclined at an angle which differs from the angle of incline of supporting surface of the structure shown in FIGS. 1 and 2.

DETAILED DESCRIPTION

Figure 1:
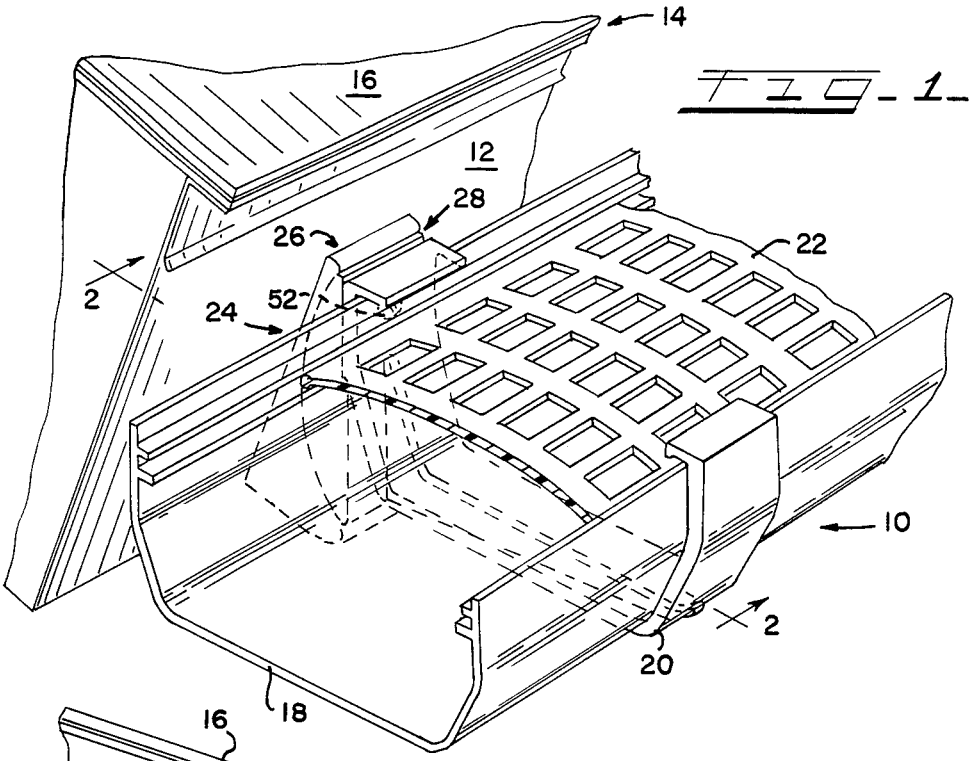
FIG. 1 is a partially cutaway perspective view of a gutter assembly mounted upon an associated structure with an adjustable mounting arrangement embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

Figure 2:
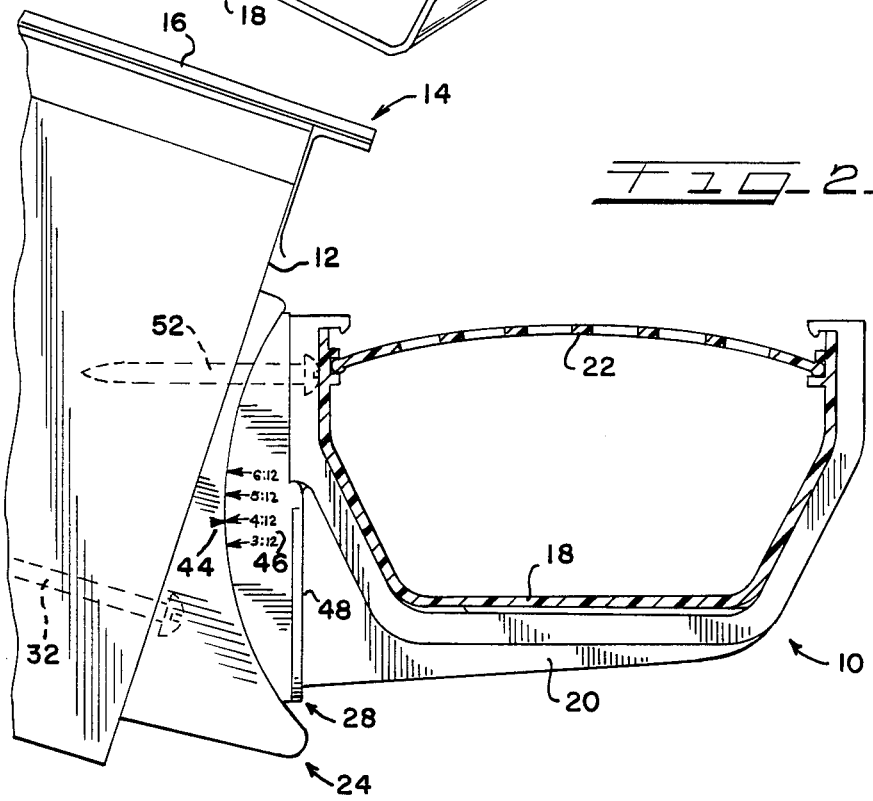
FIG. 2 is a view in partial cross-section taken along lines 2—2 of FIG. 1 further illustrating the adjustable mounting arrangement of the present invention.

With reference first to FIGS. 1 and 2, therein is illustrated a gutter assembly 10 mounted on an associated fascia board supporting surface 12 of a structure 14. Water from roof 16 of structure 14 falls into gutter 18 of the assembly for flow to an associated downspout or the like. As will be recognized by those familiar with the art, gutter assembly 10 has been illustrated as a typical plastic gutter assembly, and thus the gutter 18 is of plastic construction and is supported by a plastic gutter bracket 20. In such an arrangement, the gutter 18 is carried and supported by a plurality of gutter brackets such as 20, but is not affixed thereto, thus accommodating thermal expansion and contraction of the gutter. In order to prevent leaves, twigs, and like debris from impeding the flow of water within the gutter 18, the assembly may include a plastic leaf screen 22 held in position by suitable ribs provided on the opposite inner surfaces of the gutter 18 so that the screen 22 spans the gutter.

The gutter assembly 10 is mounted on supporting surface 12 by an adjustable mounting arrangement, generally designated 24, embodying the principles of the present invention. While the present mounting arrangement is disclosed in a configuration which facilitates its use with a plastic gutter assembly such as shown, it will be understood that a mounting arrangement embodying the principles of the present invention can be readily provided for use with gutter assemblies of different configurations. While the mounting arrangement preferably comprises suitably molded and color-impregnated plastic elements for economy, durability, and attractive finish, it will further be recognized that a like mounting arrangement can be readily fabricated from non-plastic materials.

The mounting arrangement 24 comprises a first base portion 26 adapted to abut supporting surface 12, and a second pad portion 28 adapted to abut and mate with the base portion 26 in any one of a plurality of relative positions. To this end, and as best shown in FIGS. 3 and 4, the base portion 26 defines a fastener opening 30 which is adapted to receive a mechanical fastener 32 therethrough for affixing the base portion 26 to supporting surface 12. In order to assure the security of the base portion mounting, the base portion preferably includes a pair of gripping projections 34 (two being shown) along each of its lateral edge portions. For both strength and economical material use, the base portion 26 is preferably of an internally-webbed configuration as illustrated.

The base portion 26 defines a generally arcuate or concave mating surface 36 against which the pad portion 28 is adapted to abut. A pair of guides 38 are preferably provided along the respective lateral edges of the mating surface 36 so that the pad portion 28 is received between the guides and held against lateral movement with respect to the base portion 26.

The mounting arrangement 24 preferably includes interengagement means for maintaining the base portion 26 and pad portion 28 in any one of a plurality of relative positions. Accordingly, the mating surface 36 of base portion 26 is provided with a plurality of laterally extending first teeth 40 which are configured for interengagement with the pad portion 28.

In order to provide secure interengagement of the pad portion 28 with the base portion 26, the pad portion is configured for receiving at least some of the first teeth 40 in any one of the plurality of relative positions of the base and pad portions. To this end, and as best shown in FIGS. 5 and 6, the pad portion 28 includes an arcuate, concave mating surface which is complemental to the mating surface 36 of base portion 26, with the mating surface of the pad portion provided with a plurality of laterally extending second teeth 42. As will be observed, pad portion 28 is preferably provided with a relatively greater plurality of the second teeth 42 than the plurality of first teeth 40 provided on base portion 26, thus permitting the base and pad portions to be relatively positioned in a large number of different orientations. If desired, suitable indicia can be provided on the base and pad portions, such as at 44 and 46, respectively, for aligning the base and pad portions in different positions which correspond to different standardized roof pitches.

Like base portion 26, the pad portion 28 is preferably of an internally-webbed configuration for efficient use of material. The gutter bracket 20 of the gutter assembly 10 is adapted to abut and fit against the surface defined by pad portion 28 generally opposite to its toothed surface, with the pad portion 28 preferably defining a generally U-shaped support flange 48 for securely supporting the gutter bracket 20.

It is presently contemplated that the mounting arrangement 24 be positioned generally between the gutter assembly such as 10 and the associated supporting surface 12 with a mechanical fastener which extends through gutter bracket 20, the mounting arrangement, and into supporting surface 12. Thus, the pad portion 28 defines a fastener opening 50 for receiving therethrough a suitable mechanical fastener 52. In order to permit the fastener 52 to extend through base portion 26 of the mounting arrangement in any one of a plurality of relative positions of the base and pad portions, the base portion 26 preferably defines an elongated fastener opening 54 (FIG. 3) through which fastener 52 is adapted to extend.

From the foregoing description, installation and use of the present adjustable mounting arrangement will be readily appreciated. The base portion 26 is located in its desired position on the supporting surface 12, and affixed in position thereon by insertion of mechanical fastener 32 through fastener opening 30. The pad portion 28 is next positioned in abutting relation against the base portion 26 in the desired relative position, with at least some of the first teeth 40 received between adjacent ones of the second teeth 42. The gutter bracket 20 is next positioned in abutting relation to the pad portion 28, with the fastener 52 thereafter inserted through the bracket, the fastener openings 50 and 54 respectively provided in the pad and base portions, and into supporting surface 12. The gutter bracket 20 is thus securely mounted on the supporting surface 12 and is ready to receive the associated gutter 18.

The adjustable nature of the present mounting arrangement will be readily appreciated by comparison of FIGS. 2 and 7. In FIG. 2, the mounting arrangement is illustrated in an orientation for mounting of gutter assembly 10 wherein the pitch of roof 16 of the structure 14 is relatively low. In contrast, the mounting arrangement and gutter assembly are illustrated in FIG. 7 as mounted upon a supporting surface 112 of a structure 114 having a roof 116 which has a relatively high pitch. Thus, it will be observed that the relative position of the base and pad portions 26 and 28 of the mounting arrangement are different for effecting mounting of the gutter assembly 10 in a generally horizontal disposition on structures having supporting surfaces of differing inclinations from the vertical.

From the foregoing, it will be observed that numerous modifications and variations can be effected without departing from the true spirit and scope of the concept of the present invention. It will be understood that no limitation with respect to the specific embodiment disclosed herein is intended or should be inferred. It is, of course, intended to cover by the appended claims all such modifications as fall within the scope of the claims.

What is claimed is:

1. A mounting arrangement for adjustably mounting a rainwater gutter on an associated supporting surface, comprising:

adjustable mounting means adapted for positioning generally between the gutter and the supporting surface, said mounting means being configured for maintaining the gutter in any one of a plurality of angular dispositions with respect to the supporting surface, whereby the gutter can be mounted in a generally horizontal disposition when the supporting surface is disposed at an angle to the vertical, said mounting means comprising a base portion configured to abut the supporting surface, and a pad portion configured to mate with and abut said base portion in any one of a plurality of relative angular positions, said pad portion being separate from said gutter, said base portion and said pad portion respectively defining generally arcuate, complemental mating surfaces configured for abutting engagement in said plurality of relative angular positions of said base and pad portions, said mating surface of said base portion being outwardly facing relative to said supporting surface, said mating surface of said pad portion being inwardly facing relative to said supporting surface, whereby said pad portion of said mounting means is movable in a direction toward said base portion and the supporting surface to bring said mating surfaces into abutting engagement, said base and pad portions comprising interengaging means including tooth means provided on the mating surface of one of said base and pad portions engageable with the other of said base and pad portions, said mounting arrangement further comprising bracket means configured to abut said pad portion and to receive the gutter, and fastener means configured to extend through said bracket means, said pad portion, and said base portion into the associated supporting surface, said base portion defining an elongated opening for receiving said fastener therethrough in any one of said plurality of relative angular positions of said base and pad portions.

2. An adjustable mounting arrangement in accordance with claim 1, wherein said tooth means comprises a plurality of first teeth on said one of said base and pad portions, said interengaging means comprising a relatively greater plurality of second teeth on the other of said base and pad portions for interengagement with at least some of said first teeth in any one of said relative angular positions of said base and pad portions.

3. A mounting arrangement for adjustably mounting a rainwater gutter on an associated supporting surface, comprising:

adjustable mounting means adapted for positioning generally between the gutter and the supporting surface for maintaining the gutter in any one of a plurality of angular dispositions with respect to the supporting surface, said mounting means comprising a base portion configured to abut the supporting surface, and a pad portion configured to mate with and abut said base portion in any one of a plurality of relative angular positions, said pad portion being separate from said gutter, interengaging means on said base and pad portions for maintaining said base portion and said pad portion in any one of said relative angular positions to facilitate mounting of the gutter in a generally horizontal disposition, said base portion and said pad portion respectively defining generally arcuate, complemental mating surfaces configured for abutting engagement in said plurality of relative angular positions of said base and pad portions, said mating surface of said base portion being outwardly facing relative to said supporting surface, said mating surface of said pad portion being inwardly facing relative to said supporting surface, whereby said pad portion of said mounting means is movable in a direction toward said base portion and the supporting surface to bring said mating surfaces into abutting engagement, said interengaging means comprising a plurality of transversely extending first teeth on the mating surface of one of said base and pad portions, and means for receiving said teeth on the mating surface of the other of said base and pad portions, and bracket means configured to abut said pad portion and receive said gutter, said pad portion including flange means engageable with said bracket means for support thereof, said mounting arrangement including fastener means configured to extend through an opening defined by said bracket means, another opening defined by said pad portion, and an elongated opening defined by said base portion into the associated supporting, said elongated opening being dimensioned for receiving said fastener means therethrough in any of said relative angular positions of said base and pad portions.

4. An adjustable mounting arrangement in accordance with claim 3, wherein said rec ing means comprises a relatively greater plural of second teeth means for receiving at least ne of said first teeth means in any one of said r tive positions.

5. An adjustable mounting arrangement in accordance with claim 1, wherein said flange means comprises a generally U-shaped flange on said pad portion for supporting said bracket means.

* * * * *